US011952919B2

(12) United States Patent
Wermundsén

(10) Patent No.: US 11,952,919 B2
(45) Date of Patent: Apr. 9, 2024

(54) BINARY CYCLE POWER SYSTEM

(71) Applicant: Weresco Oy, Kärrby (FI)

(72) Inventor: Juha Reidar Wermundsén, Sipoo (FI)

(73) Assignee: WERESCO OY, Kärby (FI)

( * ) Notice: Subject to any disclaimer, the term of this patent is extended or adjusted under 35 U.S.C. 154(b) by 0 days.

(21) Appl. No.: 17/596,718

(22) PCT Filed: Jun. 17, 2020

(86) PCT No.: PCT/FI2020/050434
§ 371 (c)(1),
(2) Date: Dec. 16, 2021

(87) PCT Pub. No.: WO2020/254727
PCT Pub. Date: Dec. 24, 2020

(65) Prior Publication Data

US 2022/0316364 A1 Oct. 6, 2022

(30) Foreign Application Priority Data

Jun. 19, 2019 (FI) ..... 20195534

(51) Int. Cl.
*F01K 17/00* (2006.01)
*F01K 7/16* (2006.01)

(52) U.S. Cl.
CPC ..... *F01K 17/005* (2013.01); *F01K 7/16* (2013.01)

(58) Field of Classification Search
CPC ..... F01K 17/005; F01K 7/16; F01K 25/10; F01K 25/08; F01K 27/00; F25B 11/00; F25B 30/00
USPC ..... 60/641.2–641.7, 651, 653, 670–681, 693
See application file for complete search history.

(56) References Cited

U.S. PATENT DOCUMENTS 3,984,050 A * 10/1976 Gustafsson ..... F25B 29/003 62/335
4,324,983 A * 4/1982 Humiston ..... F03G 7/05 290/1 R
4,347,705 A * 9/1982 Mirante ..... F01K 25/08 60/671

(Continued)

FOREIGN PATENT DOCUMENTS

JP 2016118365 A 6/2016

OTHER PUBLICATIONS

Search Report, Finland Patent Application No. 20195534, dated Jan. 14, 2020 (1 page).

(Continued)

*Primary Examiner* — Hoang M Nguyen
(74) *Attorney, Agent, or Firm* — Thomas | Horstemeyer, LLP

(57) ABSTRACT

The application relates to a binary cycle power system for generating electrical power. The system comprises a heat exchanger for evaporating a first fluid, a turbine converter, an electrical generator, and a first condenser for condensing the evaporated first fluid. The turbine converter converts energy of the evaporated first fluid to mechanical energy and the electrical generator generates the electrical power from the mechanical energy. The heat exchanger is a second conderser, which is a part of a heat pump that transfers heat from a second fluid circulating in the heat pump to the first fluid so that the first fluid evaporates.

6 Claims, 1 Drawing Sheet

(56) References Cited

U.S. PATENT DOCUMENTS

| | | | | |
|---|---|---|---|---|
| 4,628,212 | A * | 12/1986 | Uehara | F03G 7/05 290/1 R |
| 11,480,160 | B1 * | 10/2022 | Mokheimer | F03G 4/001 |
| 2007/0144195 | A1 | 6/2007 | Mahl, III | |
| 2009/0126381 | A1 | 5/2009 | Diaz | |
| 2016/0265392 | A1 | 9/2016 | Mabile | |

OTHER PUBLICATIONS

Written Opinion, International Patent Application No. PCT/FI2020/050434, dated Sep. 21, 2021 (7 pages).
Supplementary European Search Report, EP Patent Application No. 20827873, dated Sep. 25, 2023.

* cited by examiner

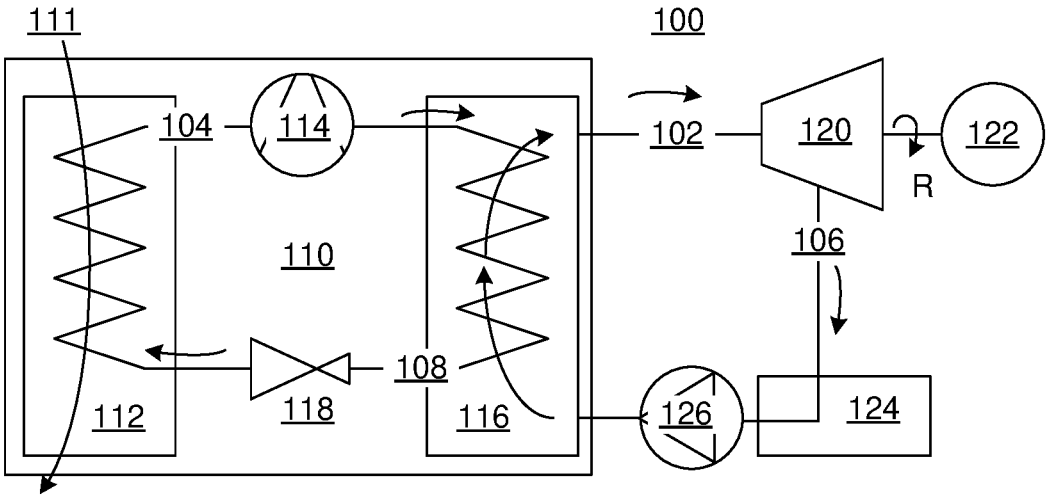
111
100
104
114
102
120
122
R
110
106
108
112
118
116
126
124

BINARY CYCLE POWER SYSTEM

CROSS-REFERENCE TO RELATED APPLICATIONS

This application is the 35 U.S.C. § 371 national stage application of PCT Application No. PCT/FI2020/050434, filed Jun. 17, 2020, where the PCT claims priority to, and the benefit of, FINNISH application no. 20195534, filed Jun. 19, 2019, both of which are herein incorporated by reference in their entireties.

TECHNICAL FIELD

The application relates generally to a binary cycle power system.

BACKGROUND

One of the most pressing issues in the world today is how can we combat climate change, e.g. rising global temperatures. The cause of climate change is caused by higher amounts of greenhouse gases that trap more warmth produced by sunlight in the atmosphere and oceans. The major greenhouse gas is carbon dioxide ($CO_2$) and the main source of its addition in the atmosphere has come from burning fossil fuels, e.g. coal, oil, and peat, for our energy needs.

One known solution to generate electrical power without the use of harmful fossil fuels is a binary cycle power plant, which utilises geothermal energy. In such plan hot water is pumped from a geothermal reservoir, circulated through a heat exchanger, and returned back to the underground reservoir. Another fluid, i.e. a binary fluid, is also pumped through the heat exchanger, where it is evaporated and, then, directed through a turbine. The evaporated fluid is condensed, after exiting the turbine, by cold air radiators or cold water, and, then, cycled back through the heat exchanger. The evaporated fluid causes the turbine to rotate and a generator, which is connected to the turbine, generates electrical power from mechanical energy produced by the turbine.

One problem in the known solutions is that those are dependent of volcanic activity, which heats water in underground reservoirs, whereupon these solutions can be place only areas where exists such activity.

SUMMARY

One object of the invention is to withdraw drawbacks of known solutions and to provide a binary cycle power system that uses an industrial heat pump to take heat, which is used in a heat exchanger in order to heat a binary fluid, from surrounding air or from lake water, river water, or seawater, and transfer this heat to the binary fluid.

One object of the invention is fulfilled by providing a power system and generating method according to the independent claims.

One embodiment of the invention is a binary cycle power system for generating electrical power. The system comprises a heat exchanger for evaporating a first fluid, a turbine converter, an electrical generator, and a first condenser for condensing the evaporated first fluid. The turbine converter converts energy of the evaporated first fluid to mechanical energy and the electrical generator generates the electrical power from the mechanical energy. The heat exchanger is a second condenser, which is a part of a heat pump. The heat pump transfers heat from a second fluid circulating in the heat pump to the first fluid so that the first fluid evaporates.

One embodiment of the invention is a generating method for generating electrical power in the binary cycle power system, which is in accordance with the previous system embodiment. The method comprises at least steps of transferring, by the second condenser, the heat from the second fluid to the first fluid so that the first fluid evaporates and converting, by the turbine converter, energy of the evaporated first fluid to the mechanical energy. The method also comprises steps of condensing, by the first condenser, the evaporated first fluid, and generating, by the electrical generator, the electrical power from the mechanical energy.

Further embodiments of the invention are defined in the dependent claims.

The embodiments of the invention will be explained with reference to the accompanying FIGURE.

DESCRIPTION OF THE FIGURE

The FIGURE presents a binary cycle power system 100 for generating electrical power clean and sufficiently effective way.

The system 100 comprises at least two cycles 102, 104, wherein one fluid 106. 108 circulates in each cycle 102, 104 in order to provide heat transfer between fluids 106, 108 and, of course, between the cycles 102, 104. The fluids 106, 108 are arranged so that a first fluid 106 circulates in the first cycle 102 and a second fluid 108 circulates in the second cycle 108.

Both first and second cycles 102, 104 comprise a channel system, which are not marked with separate reference numbers in the FIGURE, and the first and second fluids 106, 108 circulate along these channel systems in the first and second cycles 102, 104.

The second cycle 104 comprises a heat pump 110, wherein the second fluid 108 circulates in order to receive heat (energy) 111 from outside the heat pump 110 and to transfer it to the first fluid 106 in the first cycle 102.

The second fluid 108 is chosen so that its boiling point, when it is in a liquid form, is optimal to a condensing process where a heat energy of a gas is condensed into a smaller volume. The second fluid 108 comprises e.g. propylene glycol or ethyl alcohol.

The heat pump 110 comprises an evaporator 112, wherein the heat energy 111 received from outside the heat pump 110, and the system 100, transfers into the second fluid 108 and the heat 111 causes an evaporation of second fluid 108, which flows through the evaporator 112.

The heat pump 110 may be an air-source heat pump that extracts the heat 111 from surrounding air to the second fluid 108 in accordance with the FIGURE.

Alternatively, the heat pump 110 may be manufactured without connecting the channel system of second cycle 104 to the evaporator 112. The second cycle 104 is also in this embodiment a closed loop, where the second fluid 108 circulates. A part of the channel system of second cycle 104, e.g. the channel part that is presented inside the structure of evaporator 112 in the FIGURE, is positioned (immergered) into water of a river or lake system, or into seawater. The heat pump 110 extracts the heat 111 from the water (seawater) to the second fluid 108, whereupon the heat energy 111 received outside the heat pump 110 (the system 100), i.e. from the water, transfers into the second fluid 108, when it flows through the immergered part of channel system of second cycle 104. This causes the evaporation of second fluid 108 correspondingly as in the evaporator 112. Otherwise, the operation of this alternative embodiment complies with the embodiment of the FIGURE.

Irrespective of how the heat pump 110 receives the heat 111, the system 100 enables clean energy and limitless energy resources for the production of electrical energy.

The heat pump 110 further comprises a compressor 114. The evaporated second fluid 108 flows along the channel system from the evaporator 112 or from the immergered part of channel system to the compressor 114, which compresses the evaporated second fluid 108 so that its pressure and temperature increases.

The heat pump 110 further comprises a second condenser (heat exchanger) 116. The pressurized and hot second fluid 108 flows along the channel system from the compressor 114 to the condenser 116 and, when the second fluid 108 flows along the second condenser 116, the heat, which is in the second fluid 108, transfers into the first fluid 106, which circulates in the first cycle 102, so that the first fluid 106 evaporates.

The second fluid 108 condenses and cools down when transferring the heat to the first fluid 106.

The heat pump 110 further comprises an expander 118. After the second fluid 108 has released its heat in the condenser 116, it flows along the channel system to the expander 118 that expands the second fluid 108 so that its pressure and temperature decreases.

Then, after the expander 118, the expanded second fluid 108 completes its cycle by returning back along the channel system to the evaporator 112 or to the immergered part of channel system, where it is ready to receive again the heat 111 from outside.

Similarly as the second cycle 104, the first cycle 102 also comprises the condenser 116 that operates as a heat exchanger in the first cycle 102. So, the heat exchanger (second condenser) 116 is shared by the heat pump 110 and the first cycle 102.

The heat exchanger 116 transfer the heat from the second fluid 108 into the first fluid 106 so that the first fluid evaporates as above has been explained.

The first fluid 106 is chosen so that its boiling point, when it is in a liquid form, is slightly higher than an ambient temperature. The first fluid 106 comprises e.g. pentane or isobutane.

An absolute pressure inside the closed loop systems 100, 110 may be controlled so that the boiling points are optimized for the available temperature, i.e. the heat 111.

The first cycle 102 further comprises a turbine converter 120. The evaporated first fluid 106 flows along a channel system of first cycle 102 from the heat exchanger 116 (from the heat pump 110) into the turbine converter 120, which converts energy of the evaporated first fluid 106 to a form of mechanical energy, i.e. rotation movement R.

The first cycle 102 further comprises an electrical generator 122. The rotation movement R, i.e. the produced mechanical energy, is used to generate electrical power in the electrical generator 122.

The first cycle 102 further comprises a (first) condenser 124. The first fluid 106, which caused the turbine converter 120 to rotate R, flows along the channel system from the turbine converter 120 towards the condenser 124, where the evaporated first fluid 106 is condensed.

The first cycle 102 further comprises a liquid pump 126. The condensed first fluid 106 flow from the condenser 124 along the channel system to the liquid pump 126, which circulates the first fluid 106 in the first cycle 102 and, thus, directs the first fluid 106 towards the heat exchanger 116.

Finally, after the liquid pump 126, the first fluid 106 completes its cycle by returning back along the channel system to the heat exchanger 116, where it is ready to receive again the heat from the second fluid 108 (from the heat pump 110).

The invention is not only restricted to these above-explained embodiments but it comprises all possible embodiments within the scope of following claims.

The invention claimed is:

1. A binary cycle power system for generating electrical power, comprising a heat exchanger for evaporating a first fluid, a turbine converter, an electrical generator, and a first condenser for condensing the evaporated first fluid, wherein the turbine converter converts energy of the evaporated first fluid to mechanical energy and the electrical generator generates the electrical power from the mechanical energy, wherein the heat exchanger is a second condenser, which is a part of a heat pump and configured to transfer heat from a second fluid circulating in a closed channel system of the heat pump into the first fluid so that the first fluid evaporates, and wherein a part of the closed channel system of the heat pump is configured to be immersed into a waterbody to allow the heat to be extracted from the waterbody and transferred to the second fluid, which circulates in the partly immersed closed channel system.

2. The system according to claim 1, wherein the waterbody is a river, lake, or sea.

3. The system according to claim 1, wherein the heat pump comprises a compressor that compresses the evaporated second fluid so that its pressure and temperature increases.

4. The system according to claim 1, wherein the heat pump comprises an expander that expands the second fluid, which has condensed and cooled when transferring the heat to the first fluid inside the second condenser, so that its pressure and temperature decreases.

5. The system according to claim 1, which comprises a liquid pump for circulating the first fluid towards the second condenser.

6. A generation method for generating electrical power in a binary cycle power system, comprising at least steps of circulating a second fluid in a closed channel system, extracting a heat from freshwater or seawater to the second fluid, which circulates in the closed channel system, transferring, by a heat exchanger operating as a second condenser, the heat from the second fluid circulating in the second condenser to a first fluid to evaporate the first fluid, converting, by a turbine converter, energy of the evaporated first fluid to a mechanical energy, generating, by an electrical generator, the electrical power from the mechanical energy, and condensing, by a first condenser, the evaporated first fluid, wherein the closed channel system is partly immersed into a waterbody to allow the heat to extract from the waterbody to the second fluid, which circulates in the partly immersed closed channel system.

* * * * *